US005730686A

United States Patent [19]

Nilsson

[11] Patent Number: 5,730,686

[45] Date of Patent: Mar. 24, 1998

[54] EXERCISE APPARATUS

[76] Inventor: Bertil Nilsson, Ronnebygatan 21a, S-371 35 Karlskrona, Sweden

[21] Appl. No.: 793,576

[22] PCT Filed: Aug. 30, 1995

[86] PCT No.: PCT/SE95/00973

§ 371 Date: Feb. 28, 1997

§ 102(e) Date: Feb. 28, 1997

[87] PCT Pub. No.: WO96/06659

PCT Pub. Date: Mar. 7, 1996

[30] Foreign Application Priority Data

Aug. 30, 1994 [SE] Sweden ..... 9402803-2

[51] Int. Cl.[6] ..... A63B 21/12

[52] U.S. Cl. ..... 482/114; 482/115; 482/133; 482/136

[58] Field of Search ..... 482/114, 115, 482/133, 136

[56] References Cited

U.S. PATENT DOCUMENTS

| | | | |
|---|---|---|---|
| 2,190,895 | 2/1940 | Turpin | 482/115 |
| 3,285,070 | 11/1966 | McDonough | 482/115 |
| 3,501,142 | 3/1970 | Johansson . | |
| 3,550,449 | 12/1970 | Henson . | |
| 3,640,525 | 2/1972 | Proctor | 482/115 |
| 4,337,050 | 6/1982 | Engalitcheff, Jr. . | |
| 4,436,303 | 3/1984 | McKillip et al. . | |
| 4,459,880 | 7/1984 | Giffune et al. . | |
| 4,471,957 | 9/1984 | Engalitcheff, Jr. . | |
| 4,647,035 | 3/1987 | Yellen | 482/115 |
| 4,768,783 | 9/1988 | Engalitcheff, Jr. . | |
| 4,826,152 | 5/1989 | Lo | 482/114 |

*Primary Examiner*—Jerome Donnelly
*Attorney, Agent, or Firm*—Beveridge, DeGrandi, Weilacher & Young, LLP

[57] ABSTRACT

An exercise apparatus comprises a frame (1), a loading assembly (2) for variable adjustment of the rotation resistance about a shaft (3) associated with the assembly, and a gripping device (8) connected to the shaft. In the exercise apparatus according to the invention, the gripping device (8) is part of a series of such devices. Coupling means (9, 10) are arranged for quick-release coupling of the different gripping devices (8) to the shaft (3) in the loading assembly (2), which by frictional engagement generates the rotation resistances, which are independently adjustable in the two directions of rotation (6, 7) of the shaft (3).

3 Claims, 2 Drawing Sheets

EXERCISE APPARATUS

FIELD OF THE INVENTION

This invention relates to an apparatus for body building, physiotherapy, and the like.

DESCRIPTION OF THE PRIOR ART

Keep-fit exercises or remedial exercises have conventionally required a number of apparatus for exercising different groups of muscles. As a rule, these exercise apparatus have utilised the action of gravity to exercise the muscles. Thus, such apparatus comprise gripping devices, which are connected to weights by means of wires. By moving the gripping device in relation to his body, the person doing the exercises also displaces the weights, generally by lifting them in one operation and lowering them in another operation.

However, such prior-art exercise apparatus are usually heavy, bulky and stationary, which is a serious drawback in physiotherapy, since the patients have to come to the workout gymnasium, instead of having it the other way around. Furthermore, the exercise apparatus make loud noises when the weights fall back to their resting positions after each completed exercising movement. Yet another drawback is that the load can only be adjusted in both directions at the same time, i.e. the same force is required to lift the weights in one operation and as is required to resist when the weights are lowered in the subsequent operation. The return force generated when the weights are lowered may, in addition, be undesirable in certain types of exercise and physiotherapy.

In an effort to solve these problems, hydraulically as well as electrically-braked exercise apparatus have been developed.

U.S. Pat. No. 4,647,041 discloses an instance of a hydraulically-braked exercise apparatus, which comprises a bottom plate, a vertical post connected to the bottom plate and a bifurcated, horizontal arm which, at one end, is rotatably connected to the post and, at the other end, supports handles. A hydraulic system generates a rotation resistance about the shaft, thus subjecting the person doing the exercises to a load when standing on the bottom plate and moving the bifurcated arm. The rotation resistance about the shaft can be switched, so as to act either when the bifurcated arm is being pulled up or when it is being pressed down.

The hydraulic apparatus according to the U.S. specification is disadvantageous in being of a fairly heavy and bulky construction, while at the same time the rotation resistance can be obtained only in one direction of rotation at a time. Furthermore, the construction suffers from a certain lack of flexibility, since the arms and the handles cannot be modified or replaced. Also, the construction is complicated and, hence, expensive.

U.S. Pat. No. 4,518,163, for instance, teaches an electrically-braked exercise apparatus, in which a U-shaped gripping device is fixedly mounted in an assembly attached to a bench, so as to enable the user to carry out the exercises when lying down. This assembly comprises electric control means which, via an electromagnetic brake, control the rotation resistance about an output shaft, to which the gripping device is attached. A plurality of angle sensors are provided round the shaft to enable variation of the load not only according to the position of the gripping device but also according to the direction of movement thereof.

Like the hydraulically-braked apparatus described above, the electrically-braked apparatus does not permit the gripping device to be replaced so as to enable specialised exercise of selected muscle groups. Although of compact design, the U.S. exercise device is not all that easy to transport, owing to the power supply required.

OBJECTS OF THE INVENTION

One object of this invention is to overcome the above problems associated with the prior art, i.e. to provide an exercise apparatus which is compact and easy to transport. In addition, the exercise apparatus should comprise but a few movable components and be as simple and robust in its construction as possible.

Another object of the invention is to provide an exercise apparatus, in which the rotation resistance about the shaft can be independently adjusted in the two directions of rotation.

It is further a desideratum that the rotation resistance should be soft and constant all the time while the user moves the gripping devices. Moreover, the apparatus should be flexible, so that it can be used for exercising most of the muscle groups of the human body.

SUMMARY OF THE INVENTION

According to the invention, an exercising apparatus includes a shaft mounted on a frame, a replaceable gripping device which is grippable by a person who is exercising, and a quick-release coupling which detachably connects the gripping device to the shaft to facilitate replacement of the gripping device by another gripping device. A first wheel is rigidly connected to the shaft when the shaft is rotated in a first direction and is rotationally disengaged from the shaft when the shaft is rotated in a second direction which is opposite to the first direction. A second wheel is rigidly connected to the shaft when the shaft is rotated in the second direction, and is rotationally disengaged from the shaft when the shaft is rotated in the first direction. A first friction element applies pressure against the periphery of the first wheel and a second friction element applies pressure against the periphery of the second wheel. The friction elements are adjustable to vary the frictional resistance to rotation of their respective wheels.

Each friction element preferably comprises at least one annular open loop which is arranged around the periphery of the wheel and has an inside diameter that is slightly larger than the outside diameter of the wheel. A clamping mechanism adjusts the application of the loop against the wheel by moving projecting end portions of the loop toward and away from each other.

The inventive device is highly flexible. Basically, it is only the imagination of the user or physiotherapist that sets the bounds to the exercising possibilities. This invention can be implemented in one's own home or in a body building centre, and be used for physiotherapeutic purposes, e.g. in hospital. In hospital, it is desirable that one does not have to transport e.g. disabled or injured people in need of rehabilitation to special exercising premises. The present invention then has the advantage of providing a device that is easily moved between the hospital wards. Basically, it is only the loading assembly proper that has to be moved between the wards, if the frame and the gripping devices are available in the respective wards.

BRIEF DESCRIPTION OF THE DRAWINGS

For exemplifying purposes, the invention will now be described in more detail with reference to the accompanying drawings, which illustrate currently preferred embodiments and in which.

DESCRIPTION OF THE EMBODIMENTS

Figure 1:
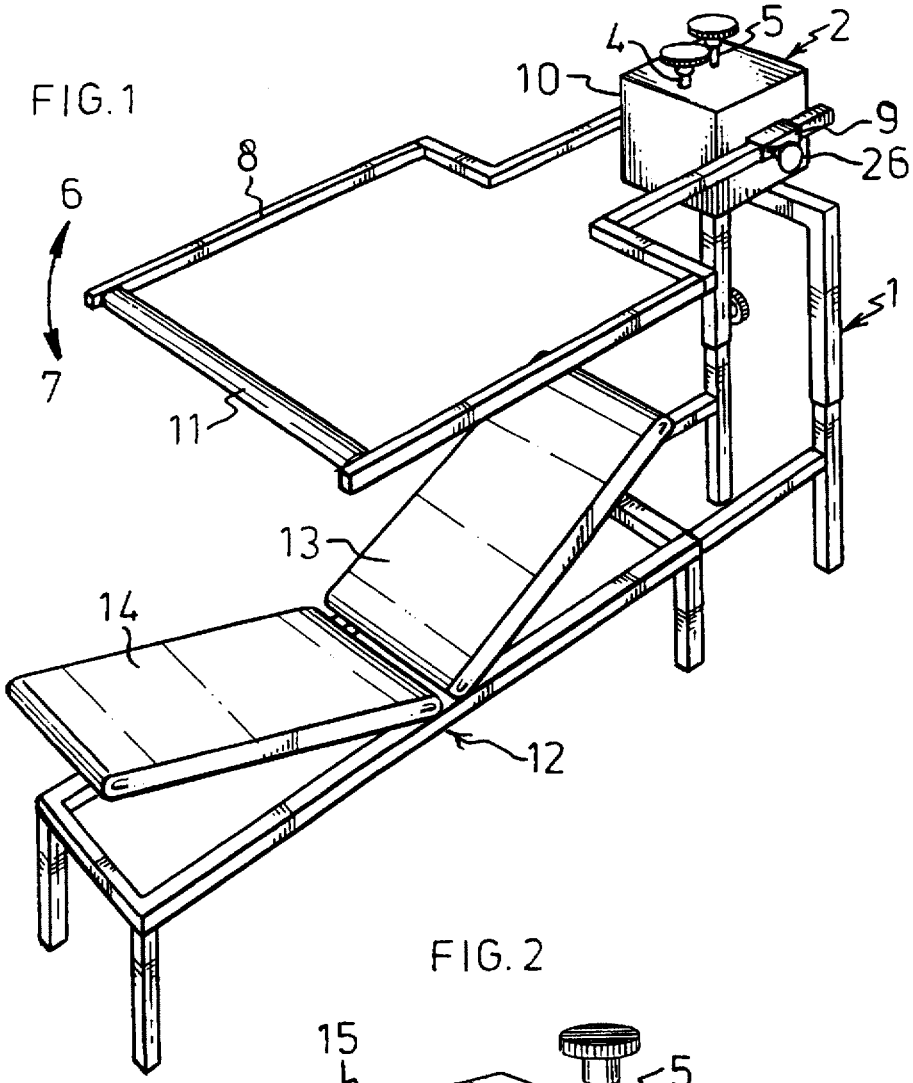
FIG. 1 is a perspective view obliquely from above, showing an exercise apparatus according to the invention.

The exercise apparatus according to the invention comprises a vertically adjustable frame 1, on which is mounted a loading assembly. This assembly, which is generally designated 2, comprises a projecting shaft 3 (see FIG. 2) about which other components of the assembly 2 generate an adjustable rotation resistance, as will be described in more detail further below. Two clamping screws 4, 5 provided with knobs are mounted on the upper side of the assembly 2. The one clamping screw 4 enables adjustment of the rotation resistance clockwise about the shaft 3, which is indicated by an arrow 6 in FIG. 1. Likewise, the other clamping screw 5 enables adjustment of the rotation resistance anticlockwise about the shaft 3, which is indicated by an arrow 7 in FIG. 1.

A gripping device 8 is attached to the projecting end portions of the shaft 3 by means of quick-release couplings 9, 10, thus enabling the user to switch between different gripping devices, which are specially designed with a view to exercising selected muscle groups. The quick-release couplings 9, 10 further enable the distance between the handle 11 of the gripping device 8 and the shaft 3 to be adjusted.

A conventional exercise bench 12 is mounted opposite to the frame 1. The bench 12 comprises a seat 13 and a back rest 14, which both can be angularly adjusted. Moreover, the distance between the bench 12 and the assembly 2 can also be adjusted.

When the illustrated exercise apparatus is to be used, one first adapts all distances between the user and the handle 11 of the gripping device 8 to suit the user. The seat 13 and the back rest 14 of the bench 12 are set in suitable angular positions in view of the exercise to be performed. Suitable rotation resistances are set with the aid of the clamping screws 4, 5, there being one rotation resistance or torque for pulling down the gripping device 8 and another torque for pressing it upwards.

In the illustrated embodiment, the user may sit upright on the bench, either facing the assembly 2 or facing away from it. Having a firm grip of the handle 11, the user may alternately pull down and press up the gripping device 8. If the distance between the handle 11 of the gripping device 8 and the assembly 2 is reduced, the user may exercise also his leg muscles by putting his feet on the handle 11. The user need not necessarily sit down when performing the exercises, but he may just as well be standing up or lying down, enabling the exercise of different muscle groups.

It goes without saying that the invention is by no means restricted to the illustrated embodiment of the gripping device 8, but that use can be made of a series of gripping devices 8, between which the user may switch thanks to the quick-release couplings 9, 10 provided at the end portions of the shaft 3. Apart from the U-shaped gripping device shown in FIG. 1, use may, for instance, be made of a T-shaped gripping device, which is attached to the one end portion of the shaft 3 by means of the quick-release coupling 9 or 10. Furthermore, an L-shaped gripping device might also be used, in which case the crossbar of the L would constitute the handle 11. A wheel-like means might also advantageously be used, as will be described in more detail below.

As mentioned in the foregoing, the quick-release couplings 9, 10 are provided at the end portions of the shaft 3 to enable the attachment of a gripping device 8 of the type indicated above. Each quick-release coupling 9, 10 is designed as a tube having a cross-sectional shape (here a square shape) corresponding to that of the gripping device 8, enabling the gripping device to be inserted in the tube and be clamped with the aid of a screw 26.

In one embodiment not shown in the drawings, also the handle 11 is replaceable, owing to the provision of one or more quick-release couplings on the gripping device 8. Thus, the handle 11 may be adapted to the exercise to be performed, and foot rests may e.g. be provided for leg exercises.

One important aspect of the invention is that the position of the assembly 2 in relation to the frame 1 is in no way restricted to the illustrated embodiment. In the arrangement shown in FIG. 1, where the shaft 3 is horizontally disposed so as to face away from the user, the user's movements are performed in a vertical plane. If, on the other hand, the assembly 2 is so attached to the frame 1 that the shaft 3 is vertically disposed, the user's movements will be performed in a horizontal plane. Should the assembly 2 be so arranged that the one end portion of the shaft 3 faces the user, lateral turning movements in a vertical plane can be carried out if the above-mentioned wheel-like gripping device is fixed to this end portion.

Figure 2:
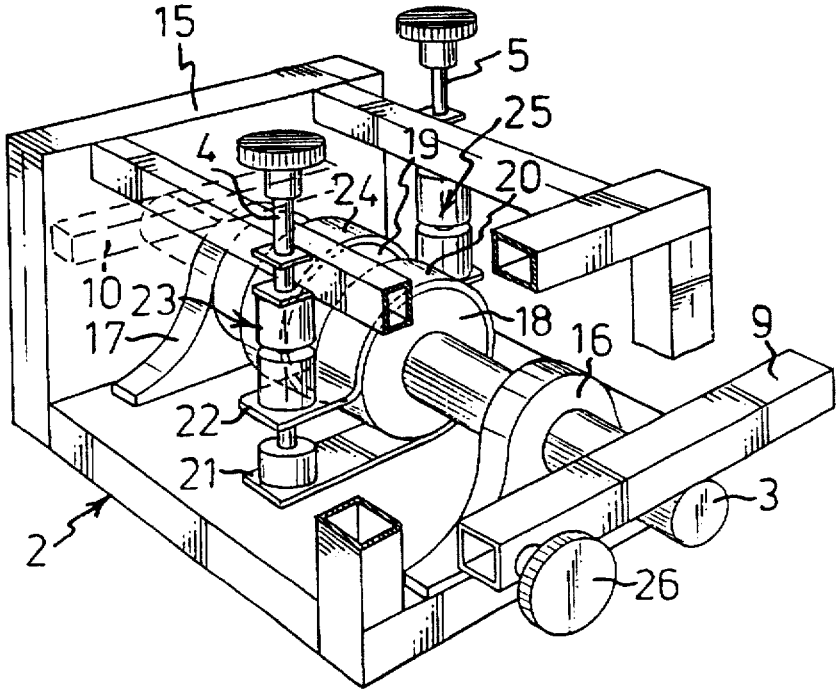
FIG. 2 is an enlarged perspective view showing a loading assembly forming part of the apparatus and being adapted to generate rotation resistance about a shaft.

The construction of the assembly 2 will now be described in more detail with reference to FIG. 2, where the casing shown in FIG. 1 has been removed to give a clear view of the interior of the assembly 2. Thus, the assembly 2 comprises a framework 15, in which a shaft 3 is rotatably mounted in a first and a second bearing 16, 17. For reasons of clarity, certain parts of the framework 15 have been cut away in FIG. 2. A first wheel 18 is arranged on the shaft 3 and is connected thereto by means of an intermediate bearing, a so-called free hub, which is fixed to the shaft 3 and is able to rotate in one direction only. When rotating, the shaft 3 thus entrains the wheel 18 in one direction but not in the other, opposite direction. Such free hubs are well-known and are available on the market. Likewise, a similar second wheel 19 with associated free hub is arranged on the shaft 3, the directions of entrainment and clearance being, however, opposite to those of the first wheel 18.

The shaft 3 is braked by frictional engagement, which can be produced with the aid of an optional friction element, which is applied against the periphery of the respective wheels. In the embodiment shown in FIG. 2, this is achieved by the provision of an annular, open loop 20 round the periphery of the first wheel 18. The arcuate gripping portion of the loop 20 has an inside diameter that is slightly larger than the outside diameter of the wheel 18. Further, the loop 20 is formed with free, projecting end portions 21, 22 which are spaced apart from each other. A clamping mechanism, which is generally designated 23, is acted upon by the screw 4 and is arranged to clamp the end portions 21, 22, such that the arcuate gripping portion of the loop 20 is applied against the periphery of the wheel 18, thus generating a braking effect thereon. Likewise, the second wheel 19 is enclosed by a similar loop 24 performing the same function. The loop 24 is clamped round the wheel 19 with the aid of a clamping mechanism 25, to which is connected the screw 5.

The clamping mechanism 23 is connected to the spaced-apart, projecting end portions 21, 22 of the loop 19, these end portions 21, 22 being movable towards and away from each other by means of the clamping mechanism 23 with a view to adjusting the grip of the loop 20 round the wheel 18. When the distance between the end portions 21, 22 is reduced, the loop 20 is clamped round the wheel 18, such that the frictional engagement between the gripping portion of the loop 20 and the wheel 18 is enhanced, as is the rotation resistance about the shaft 3 in the direction at issue. When, on the other hand, the distance between the end portions 21, 22 is increased, the frictional engagement is reduced, such that the rotation resistance about the shaft 3 decreases.

Consequently, the wheels 18, 19 arranged on the shaft 3 and having opposite directions of entrainment and free-wheeling cooperate with the respective loops 20, 24 so as to generate the rotation resistances about the shaft 3, these rotation resistances being independently adjustable in the two directions of rotation 6, 7 of the shaft 3 by means of the respective clamping mechanisms 23, 25.

Naturally, the grip the loop 19 has of the wheel 18 can be achieved in some other way, and the clamping mechanism 23 may, for instance, be a squeezing device or some other sort of device enabling the user to adjust the application of the loop against the periphery of the wheel 18 and, hence, vary the load during the exercise.

Figure 3:
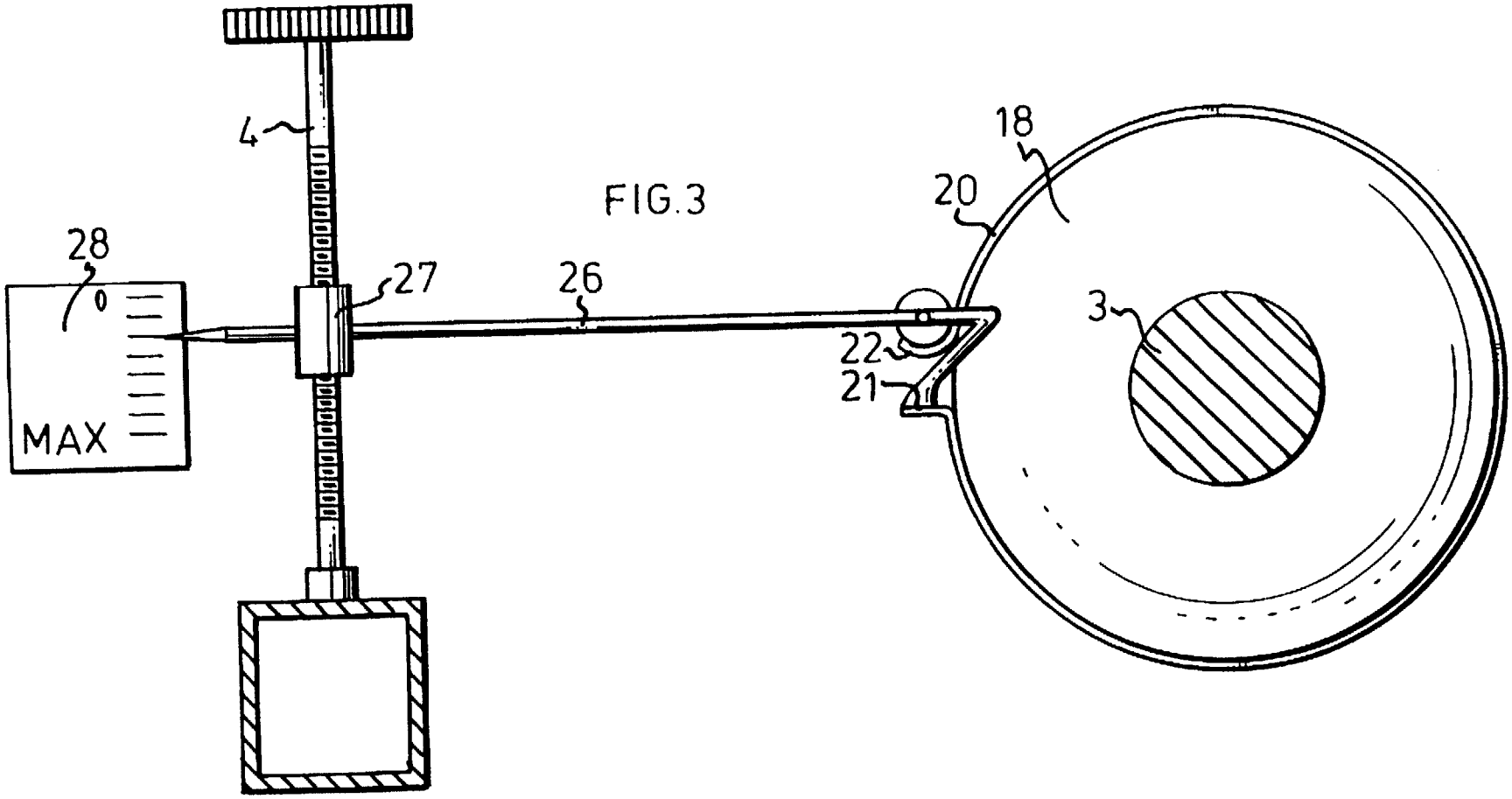
FIG. 3 is a schematic side view showing an alternative mechanism for adjusting the rotation resistance of the loading assembly, as well as an indicating device for quantifying the rotation resistance.

FIG. 3 schematically illustrates an instance of an alternative clamping mechanism, which works on the lever principle, so as to clamp the loop 20 round the wheel 18. At one end, a lever 26 is connected to the one end portion 21 of the loop 20. The lever 26 extends over, and is slidably connected to, the other end portion 22 of the loop 20. At the other end, the lever 26 is equipped with a threaded nut 27. A threaded clamping screw 4 connected to a knob is screwed through the nut 27 and is rotatably accommodated in the framework 15. The threaded nut 27 is connected to an indicating means 28 in the form of a tip projecting from the nut 27 and being arranged in conjunction with a scale.

Owing to the distance between the threaded nut 27 and the end portions 21, 22 of the loop 20, a comparatively insignificant displacement of the threaded nut 27 along the clamping screw 4 causes the loop 20 to be applied against the periphery of the wheel 18 with a considerable force.

Preferably, the indication provided by the indicating means 28 is calibrated in relation to the rotation resistance about the shaft 3, such that the effort put into the exercise can be quantified.

It will be appreciated that the second wheel 19 may be provided with a similar clamping mechanism.

We claim:

1. An exercising apparatus comprising:

a frame;

a shaft mounted on the frame;

a gripping device which is grippable by a person who is exercising;

a quick-release coupling detachably connecting the gripping device to the shaft to facilitate replacement of the gripping device by another gripping device;

a first wheel which is rigidly connected to the shaft when said shaft is rotated in a first direction and is rotationally disengaged from the shaft when the shaft is rotated in a second direction which is opposite to said first direction;

a first friction element applying pressure against the periphery of the first wheel to provide frictional resistance to rotation of said first wheel, said first friction element being adjustable to vary the frictional resistance to rotation of the first wheel;

a second wheel which is rigidly connected to the shaft when said shaft is rotated in said second direction and is rotationally disengaged from the shaft when the shaft is rotated in said first direction;

a second friction element applying pressure against the periphery of the second wheel to provide frictional resistance to rotation of said second wheel, said second friction element being adjustable to vary the frictional resistance to rotation of the second wheel.

2. An apparatus as claimed in claim 1, wherein each friction element comprises at least one annular, open loop, whose gripping portion has an inside diameter that is slightly larger than the outside diameter of the wheel, said loop being arranged around the periphery of the wheel, and the application of the loop against the wheel being adjustable with the aid of a clamping mechanism.

3. An apparatus as set forth in claim 2, wherein the clamping mechanism is connected to projecting end portions: of the loop, said end portions being spaced apart and movable towards and away from each other by means of the clamping mechanism, so as to adjust the grip of the loop around the wheel.

* * * * *